United States Patent [19]

Sparks et al.

[11] Patent Number: 4,559,610

[45] Date of Patent: Dec. 17, 1985

[54] GAS PUMPING SYSTEM ANALOG

[75] Inventors: Cecil R. Sparks, San Antonio; Carl E. Edlund, Castroville; Morton E. Brown, San Antonio, all of Tex.

[73] Assignee: Southwest Research Corporation, San Antonio, Tex.

[21] Appl. No.: 491,358

[22] Filed: May 4, 1983

[51] Int. Cl.[4] ..... G06G 7/57

[52] U.S. Cl. ..... 364/803; 364/578; 364/510

[58] Field of Search ..... 364/801, 802, 803, 806, 364/510, 578, 512, 509, 506

[56] References Cited

U.S. PATENT DOCUMENTS

| | | | |
|---|---|---|---|
| 2,509,042 | 5/1950 | McIlroy | 364/803 |
| 2,695,750 | 11/1954 | Kayan | 364/803 |
| 2,936,041 | 5/1960 | Sharp et al. | 181/47 |
| 2,951,638 | 9/1960 | Hughes et al. | 235/183 |
| 2,979,940 | 4/1961 | Damewood et al. | 73/71.4 |
| 2,997,124 | 8/1961 | Damewood et al. | 181/47 |
| 3,506,819 | 10/1965 | Carli et al. | 364/803 |
| 3,529,144 | 9/1970 | Patterson et al. | 364/803 |
| 3,551,694 | 12/1970 | Boxall | 364/803 |
| 3,599,233 | 8/1971 | Meyer | 364/803 |
| 4,404,646 | 9/1983 | Edlund et al. | 364/803 |
| 4,424,571 | 1/1984 | Edlund | 364/801 |
| 4,475,168 | 10/1984 | Brown | 364/803 |

*Primary Examiner*—Michael R. Fleming

*Attorney, Agent, or Firm*—Hubbard, Thurman, Turner & Tucker

[57] ABSTRACT

A system for electrically simulating the acoustical properties of a fluid transfer system including an electrical circuit for simulating the acoustic properties of fluid piping and an electrical circuit coupled to the fluid piping circuit for electrically simulating the acoustical properties of fluid transfer through at least one cylinder of a reciprocating compressor wherein the reciprocating compressor simulation circuitry includes a variable capacitor that simulates a change of volume and pressure within the compressor by varying the magnitude of capacitance. The system also includes the means for electrically simulating the acoustic properties of a centrifugal compressor including a variable capacitor for simulating flow through the compressor. This system further includes an output circuit for displaying the operational parameters of the system. One embodiment includes a central processing unit that provides for the loading of memories for supplying operational data to the reciprocating compressor simulation circuits and the centrifugal compressor circuits and receives the resulting data measured from these system circuits to compute the acoustic operational parameters for the system for display.

21 Claims, 12 Drawing Figures

GAS PUMPING SYSTEM ANALOG

BACKGROUND

1. Field of the Invention

The present invention relates generally to devices for electrically simulating fluid pumping and compressor systems, and more specifically to a system for simulating a gas compressor and associated pipelines.

2. Description of Related Art

Installation or modification of natural gas or other fluid distribution systems requires consideration of a number of factors before work is undertaken. Variations in loads, distribution paths, pipe sizes and compressor speeds all have effects on the operation of the system as a whole. Compression waves created in the gas by the operation of reciprocating pumps and compressors are especially troublesome, as fluid acoustic resonances can be set up in the system. These resonances increase metal fatigue and shorten the life of joints, valves and other components of the system, and often degrade compressor performance. Acoustic resonances through centrifugal pumps can cause surge and loss of pressure head.

To assist in planning for control of pulsations and vibrations, an electrical analog of all fluid handling components can be created. Present electrical systems analogize current to mass flow of the gas and voltage to pressure. Inductors, capacitors and resistors are used to model the acoustical properties of pipes and other components in the distribution system. A detailed model of pumping or compressing system or subsystem can be set up and studied to predict the effects caused by changing various parameters in its operation.

In order to utilize easily obtained components, the operating frequency of the electrical analog is typically substantially higher than that of the mechanical system. An electrical to mechanical frequency ratio is typically in the neighborhood of 1000 to one. Component values and analog system parameters are chosen so that all events which occur during the operation of the model reflect events which will take place in the mechanical system. For example, the presence of an electrical resonance in the analog system at a certain frequency corresponds to an acoustical resonance in the mechanical system at the corresponding mechanical speed.

The present state of the art in pumping system analogs is typified by U.S. Pat. No. 2,951,638, issued to Hughes, et al. The system described therein shows a model of a reciprocating compressor utilizing a capacitor which is driven by a sinusoidal voltage source. Due to inaccuracies inherent in the use of a fixed capacitor to model the changing volume of a compressor cylinder, the driving voltage signal to the capacitor must be shaped to compensate for both pressure and volume changes.

Since a fixed capacitance is used to model a time varying volume, it is not possible for the model to present the correct acoustic compliant reactance to both the intake and discharge ports of the model when the respective valves are opened to the remainder of the circuit. The volume of the mechanical cylinder is at or near a minimum value near the end of the discharge cycle, and at or near a maximum value near the end of the intake cycle. Thus, it is at best possible to only approximate the proper impedance to either the intake or discharge port of the model cylinder, with the impedance at the other port differing substantially from the correct value.

Further, it is necessary that the correct current, which is analogous to mass flow of the gas, be transported through the analog on each cycle. In order to meet this criteria, it is frequently impossible to present the proper cylinder impedance to either the intake or discharge port.

In practice, it is necessary to arbitrarily choose a capacitance which lies somewhere in the range between the minimum and maximum values presented to the cylinder port. The magnitude and shape of the driving signal are then aribitrarily adjusted until the proper pressure-volume diagram is obtained for the particular cylinder being modeled, and the value of the capacitance is then arbitrarily readjusted to obtain the proper analog current flow. The analog models the mechanical compressor only approximately, with a degree of accuracy primarily dependent upon the skill of the model operator. The capacitor can in no sense be considered to correspond to any real physical volume, with the result that the reactance presented by the model cylinder to the rest of the circuit is incorrect. This inaccuracy causes the results of the simulation to be correspondingly inaccurate.

Additionally, because the driving signal for the electrical model has been arbitrarily shaped, conventional phase meters cannot be used to control the relative phasing between several cylinders, which is necessary when modeling a multi-cylinder compressor. Accurate phasing between cylinders is this rendered difficult.

Many pumping and transport systems utilize centrifugal, as well as reciprocating, compressors. The pressure differential across the compressor and the pump volume vary with changes in the instantaneous operating conditions of the compressor. Variations in intake and/or discharge pressures of flow volume, caused for example by reciprocating compressors and acoustic resonances in the piping, change the centrifugal compressor pressure flow outputs in accordance with specifications supplied by the manufacturers. Centrifugal compressors present an acoustic impedance to the pumping system which must be taken into account to accurately model the system.

Present analog systems use diodes to simulate unidirectional mechanical valves. Because of the inherent characteristics of diodes, they do not accurately simulate the acoustic properties of such valves. Additionally, there is not suitable method for simulating the operation of a pressure relief valve.

It would be desirable for an electrical analog of gas pumping system to accurately simulate the acoustic properties of valves, reciprocating and centrifugal, compressors, cylinders and other mechanical objects in the system. It would also be desirable that such simulation includes suitable means for monitoring operation of the analog so that accurate determinations of the analog, and thus the mechanical system, operating conditions can be made.

It is therefore an object of the present invention to provide an electrical model of a gas pumping system, which utilizes reciprocating or centrifugal pumps or compressors, which accurately simulates the acoustic properties of the various mechanical parts.

It is another object of the present invention to provide such a system simulation which provides suitable monitoring devices so that an operator can insure accurate operation of the simulation and determine previously unknown values corresponding to mechanical conditions.

SUMMARY OF THE INVENTION

In accordance with the present invention, a system for electrically simulating the acoustical properties of a fluid transfer system is disclosed that includes an electrical circuit for simulating the acoustic properties of fluid piping and an electrical circuit coupled to the fluid piping circuit for electrically simulating the acoustical properties of fluid transfer through at least one cylinder of a reciprocating compressor, wherein the compressor simulating circuit includes a variable capacitance whose capacitance varies to simulate volume and pressure changes of the compressor cylinder and piston. Also included is an electrical circuit that simulates the acoustical properties of a centrifugal compressor that includes a variable capacitance that changes to simulate the change in fluid flow through the compressor, and output circuitry selectively connected to the piping simulation circuitry, the cylinder simulation circuitry and the centrifugal pump simulation circuitry for displaying the operational characteristics of the system.

In a preferred embodiment, a system for electrically simulating the acoustical properties of a fluid transfer system is disclosed that includes a piping simulation circuit including at least one lumped parameter delay line including inductors and capacitors arranged in a $\pi$ circuit. This system further includes electrical simulation of unidirectional valves as diodes. Furthermore, the simulation of the reciprocating compressor cylinder includes the variable capacitance having a circuit connected to a memory that stores volume and pressure data as a function of crankshaft angle where the crankshaft angle is simulated by a counter. In operation the reciprocating compressor operation is simulated by the interation of the counter by a clock signal. The memory outputs are used to adjust the capacitance of the variable capacitor for electrically simulating the acoustical properties of this reciprocating compressor. The centrifugal compressor further includes a fixed capacitance pump and includes a memory for the storage of compressor performance data.

In another embodiment of the invention, a central processing unit is connected to the simulating circuits and loads the memories of the reciprocating compressor and a centrifugal compressor and further records the current and voltage outputs from the system. In this embodiment, the central processing unit further computes system operating parameters from this measured data and displays these parameters.

BRIEF DESCRIPTION OF THE DRAWINGS

The novel features which characterize the present invention are defined by the appended claims. The foregoing and other object and advantages will hereinafter appear, and for purposes of illustration, but not of limitation, preferred embodiments of the invention are shown in the accompanying drawings.

DESCRIPTION OF THE PREFERRED EMBODIMENTS

Figure 1:
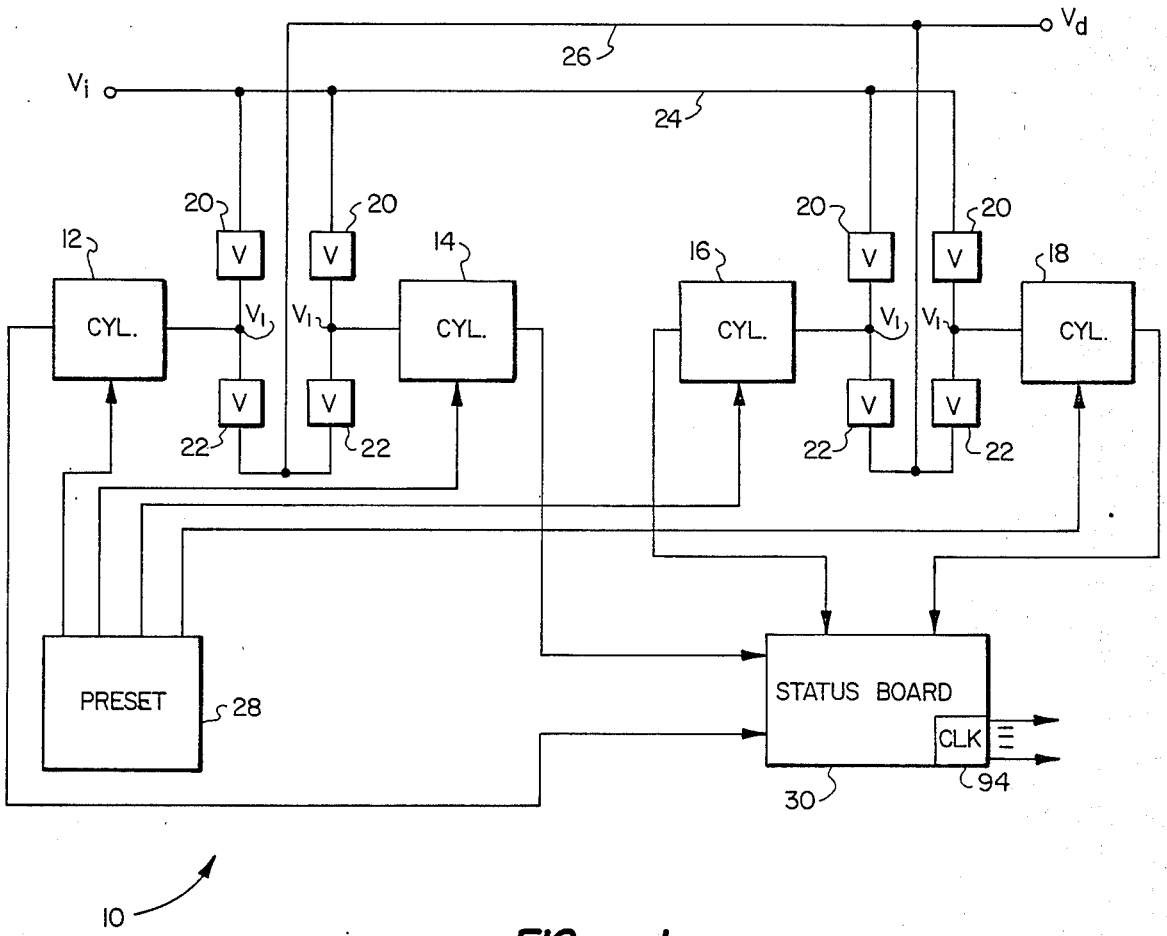
FIG. 1 is a block diagram of an electrical analog of a reciprocating fluid pump or compressor.

The present analog system is designed to model the action of a fluid pumping or compression system utilizing reciprocating and centrifugal compressors or pumps. The description will be given with respect to a natural gas compressor system, but it is understood that the present invention is also applicable to modeling the activities of systems utilizing similar physical principles to those of compressor pumping systems.

The present invention is directed to a system which includes electrical models of the piston and cylinder in reciprocating compressors, models of centrifugal compressors, the intake and discharge piping associated with compressor systems, and test instruments to monitor the operation of the analog. These subsystems can be coupled together to simulate the acoustical properties of systems ranging in size and complexity from the action of a single compressor cylinder to a complete model of as much of an actual gas pumping system as is desired, including multiple compressors operated independently, associated piping between compressors, transmission lines to distant locations, vibration and pulsation eliminators located in the transmission lines, etc. A model can be set up to study the operation of a system when using various piping arrangements, compressor speeds, and so forth. Electrical properties of the analog correspond directly to the acoustical properties of the actual system, so that electrical resonances in the simulation corresponding to acoustic resonances in the natural gas. These resonances in the mechanical system can lead to excess vibration and increased component fatigue, thereby shortening the life of portions of the system and increasing maintenance costs. Such problems can be isolated on the electrical simulation and proposed solutions tested thereon to determine if they are satisfactory. Electrical simulation can also be used to determine the operating efficiency of the system, as well as pressures and fluid flows at various points of interest. The electrical mode is thus useful at the design stage and at the maintenance stage.

The operating parameters used by the improved apparatus of the present invention are the same as those set forth in U.S. Pat. No. 2,951,638, issued to Hughes, et al. The corresponding electrical and acoustic-mechanical properties are as follows:

| Electrical Property | Acoustical-Mechanical Property |
|---|---|
| V (voltage) | P (pressure) |
| Q (charge) | m (mass of gas) |
| I (current) | M (mass rate of gas flow) |
| L (inductance) | 1/A (A = cross sectional area of |

-continued

| Electrical Property | Acoustical-Mechanical Property |
|---|---|
| | pipe) |
| C (capacitance) | $A\rho/B$ ($\rho$ = density; B = bulk modulus of gas) |

The following five design parameters are chosen to determine the magnitude of the electrical properties used in the simulation. The five parameters are defined as follows:

$$\propto = P/V \quad (1)$$

$$\beta = M/I \quad (2)$$

$$\gamma = a_s/a_e \quad (3)$$

$$\delta = f_s/f_e \quad (4)$$

$$\epsilon = \lambda_s/\lambda_e \quad (20)$$

where $a_s$ and $a_e$ are the velocity of sound waves in a gas and electrical waves in a conductor, respectively, $f_s$ and $f_e$ are the frequencies of the sound waves and electrical waves, respectively, and $\lambda_s$ and $\lambda_e$ are the acoustical wavelength in feet of pipe per wavelength, and electrical wavelength in sections of pipe per wavelength, respectively. Additional relationships will be defined under the discussion relating to the simulation of piping. $\propto$ is set by choosing a convenient value for V, usually in the range of 3–30 volts, and $\delta$ is set to a convenient value. A preferred value for $\delta$ lies in the neighborhood of 1/1000, which will allow the use of inductors and capacitors having easily obtained values. Determination of $\beta$, $\gamma$ and $\epsilon$ will be discussed in connection with FIGS. 7 and 8.

Referring to FIG. 1, an electrical analog of the reciprocating compressor portion of the system is indicated generally by reference numeral 10. The compressor 10 models a two cylinder, double acting reciprocating compressor, but other arrangements are contemplated by the present invention and will become apparent to those skilled in the art. A double acting mechanical cylinder compresses gas in both the crank and the head end, and these ends operate 180° out of phase. In the analog compressor 10, the ends of the mechanical cylinder are modeled by two single acting analog cylinders which are driven 180° out of phase. The analog 10 therefore includes first head-end 12 and crank-end 14 analog cylinders, and second head-end 16 and crank-end 18 cylinders. Each analog cylinder has its own intake valves and 20 and discharge valves 22, with the intake valves 20 being coupled to a common intake line 24; and the discharge valves 22 coupled to a common discharge line 26. All valves 20, 22 are unidirectional valves, and a preferred valve simulation is discussed in connection with FIG. 2. Gas pressure in the intake line 24 is represented by an intake voltage $V_i$, and a discharge voltage $V_d$ models the gas pressure in the discharge line 26.

In the mechanical system, the compressor cylinders will be coupled to the crankshaft in such a manner that they are 90° out of phase, which gives the effect of four single acting cylinders spaced equally around the crankshaft. In the simulation 10, the analog cylinders 12, 14, 16 and 18 will be driven with 90° phase spacings to accurately mode the mechanical arrangement.

A preset control circuit 28, which can be programmed general purpose digital computer, is coupled to each cylinder analog, and is used to set the cylinder operating characteristics and relative phasing of the analog cylinders as described below. Each analog cylinder is coupled to a status board 30, which is used to monitor the operation of the system. The status board 30 includes a clock 94 as described in connection with FIG. 5, which is used to synchronize operation of the reciprocating compressor 10.

Figure 2:
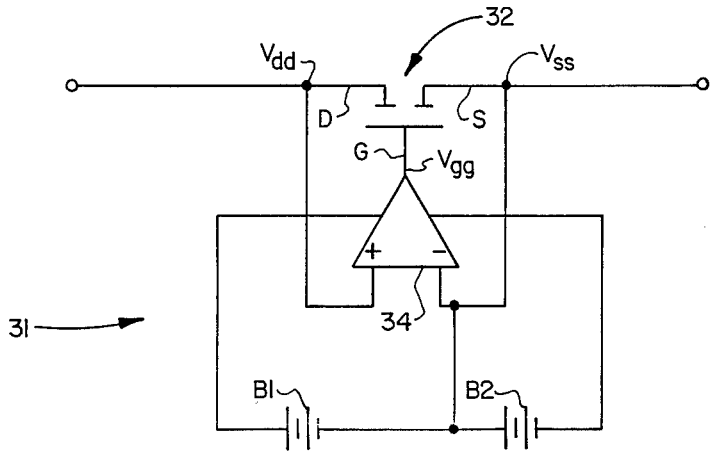
FIG. 2 is an electrical analog of a mechanical valve.

A preferred embodiment of an analog unidirectional valve 31 is shown in FIG. 2. This simulation 31 is used for each of the intake and discharge valves 20, 22 described in connection with FIG. 1. A transistor 32 having drain (D), a source (S) and gate (G) terminals is preferably an N-channel enhancement mode field effect transistor. The transistor 32 conducts current between the drain and source terminals D and S when a gate voltage $V_{gg}$ is higher than a source voltage $V_{ss}$. In this state, the transistor 32 is turned ON, and there is a very low resistance to current flow between the drain D and the source S. When the gate to source voltage ($V_{gg}-V_{ss}$) is below the threshold of the transistor 32, the drain to source path (D to S) is essentially an open circuit.

The drain terminal D is coupled to the positive input of a voltage comparator 34, and the source terminal S is connected to the negative input of the comparator 34. The output of the comparator 34 is coupled to the gate terminal G of the transistor 32. Power is supplied to the comparator 34 by batteries B1 and B2, which provide a floating voltage supply independent of the remainder of the system 10. The batteries B1, B2 supply the same voltage, and the negative input of the comparator 34 is coupled to the junction between them. This references the comparator 34 to the instantaneous source voltage $V_{ss}$, instead of to a fixed value. The life of the batteries B1, B2 is quite long, because the power requirements of the valve model 31 are very low. The input resistance to the comparator 34 are high, and no current flows through the gate G, so there is no input or output current to the comparator 34. The only current used is that drawn by the comparator 34 itself during operation.

The output voltage $V_{gg}$ from the comparator 34 will be substantially equal to either the positive or negative voltage supply, which is defined by B1 and B2 as referenced to $V_{ss}$, depending on the relative magnitude of the voltages into the positive and negative inputs of the comparator 34. Switching of the comparator output $V_{gg}$ between the positive and negative value is extremely fast and is limited only by the slew rate of the comparator 34.

In operation, if the source voltage $V_{ss}$ is greater than a drain voltage $V_{dd}$, the voltage at the negative input to the comparator 34 is greater than that at the positive, and the comparator output $V_{gg}$ is substantially equal to the lowest voltage supplied by the power supply of B1 and B2. This voltage will be lower than $V_{ss}$ by the voltage supplied by battery B1. This causes the transistor 32 to be in a nonconducting state, and no current flows between the source S and drain D. If the source voltage $V_{ss}$ drops below the drain voltage $V_{dd}$, then the comparator output $V_{gg}$ will switch to the maximum positive voltage supplied by the power supply, which will be greater than $V_{ss}$ by the voltage supplied by battery B2. This causes the gate voltage $V_{gg}$ to become positive with respect to the source voltage $V_{ss}$, which switches the transistor 32 into the conducting state. Current is now free to flow from the drain D to the source S.

When the transistor 32 is in the conducting state, and the drain voltage $V_{dd}$ falls below the source voltage $V_{ss}$, the gate voltage $V_{gg}$ will be driven negative with respect to the source voltage $V_{ss}$, which turns the transistor 32 OFF. It is thus seen that the valve model 31 acts to conduct current whenever the drain voltage $V_{dd}$ is higher than the source voltage $V_{ss}$, and to present an open circuit when the source voltage $V_{ss}$ is higher than the drain voltage $V_{dd}$. This is precisely analogous to the opening and closing of a mechanical valve.

A variation of the standard unidirectional valve model 31 can be used to model any pressure relief valves needed in the simulation. By inserting a DC voltage source (not shown) in either the line from the source S to the negative input of the comparator 34, or the line from the drain D to the positive of the comparator 34, an offset can be introduced into the model 31. The direction and location of the floating source determine whether the device 31 will change states when the drain D is at a higher potential than the source S, or vice versa. For example, with a 3 volt battery coupled into the source S to comparator 34 input line, oriented with the positive terminal toward the comparator 34, the device will change states when the drain D becomes more or less than 3 volts greater than the source S. This simulates the action of a mechanical pressure relief valve.

Figure 4:
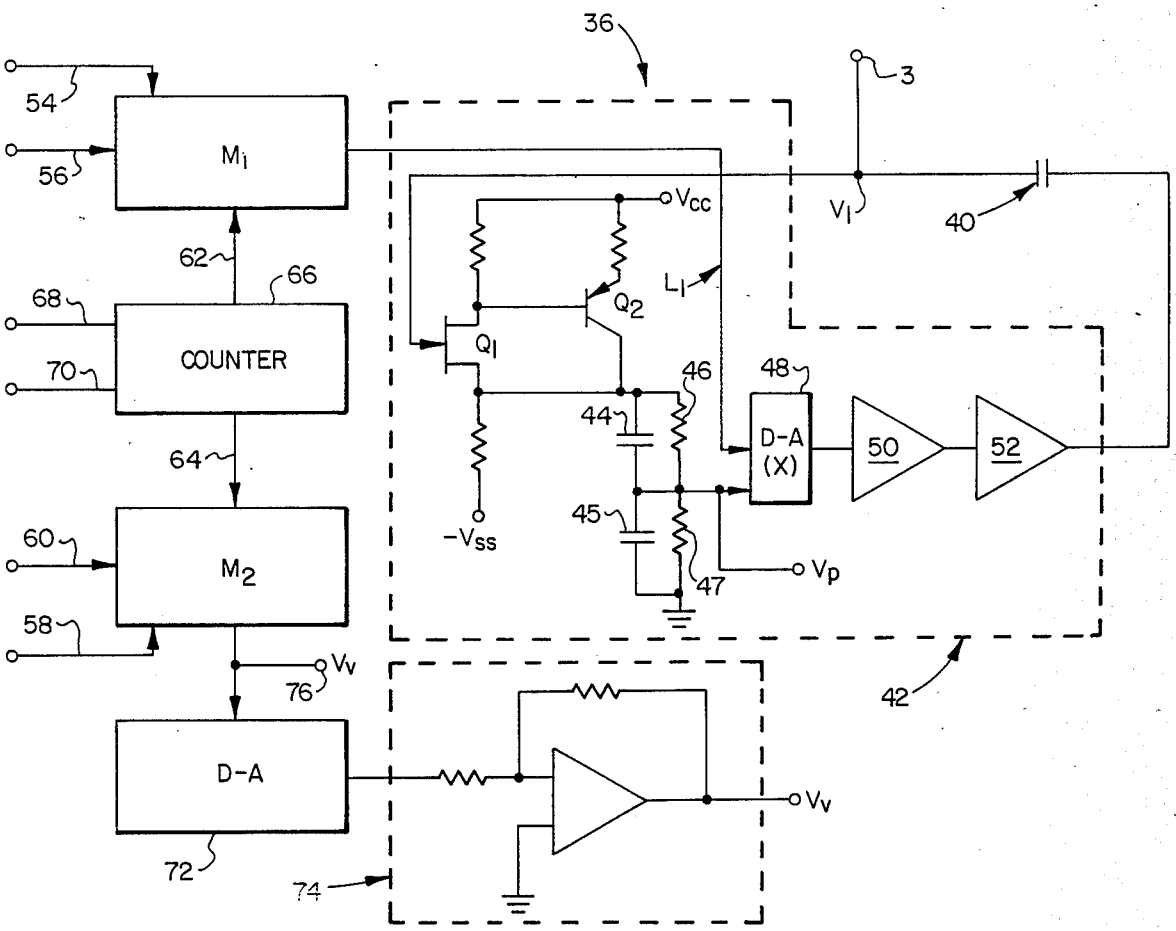
FIG. 4 is a combined schematic and block diagram of a reciprocating compressor cylinder analog.

The analog reciprocating cylinders 12, 14, 16, 18 are preferably modeled by the circuit 36 shown in FIG. 4. Such model 36 synthesizes a variable capacitor, which is time controllable by an electrical signal, to simulate the changing volume, and thus the changing acoustic compliance, of a cylinder and reciprocating piston.

Figure 3:
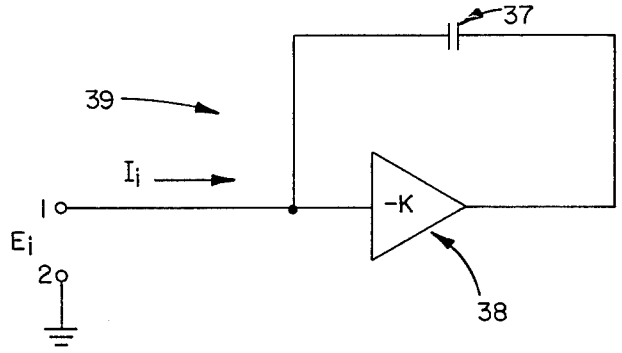
FIG. 3 is a schematic diagram of a circuit for simulating a variable capacitor.

The general method used by the present invention for simulating a variable capacitor is shown in FIG. 3. $E_i$ is the voltage between terminals 1 and 2, while $I_i$ is the current into terminal 1. A fixed capacitor 37 has a value of $C_o$, and an amplifier 38 is assumed to be an ideal amplifier with a gain of $-K$.

The electrical impedance $Z_i$ across terminals 1 and 2 is given by the equation:

$$Z_i = \frac{E_i}{I_i} = \frac{-j}{\omega(1+K)C_o} \tag{5}$$

The impedance $Z_c$ of a pure electrical capacitance is given by the equation:

$$Z_c = -j/wc \tag{6}$$

A comparison of equations 5 and 6 shows that the complex impedance looking into terminals 1 and 2 of the circuit 39 is equivalent to a pure electrical capacitance having a magnitude of:

$$C = (1+K)C_o \tag{7}$$

so that the circuit 39 synthesizes a variable capacitor having a value determined by the instantaneous gain of the controllable amplifier 38.

The general equation for analog capacitance is:

$$C = \frac{\propto \gamma}{\beta} \cdot \frac{A\rho}{B} \tag{8}$$

Additionally:

$$B = nP = n \propto V \tag{9}$$

where n is the isentropic compression exponent for a gas at a particular temperature and pressure. Combining equations (1), (8) and (9) gives:

$$C = \frac{\propto^2 \gamma}{\beta} \cdot \frac{A\rho}{nV} = \frac{K_o A\rho}{nV} \tag{10}$$

$$CVn = K_o A\rho \tag{11}$$

$CV = Q$ (charge), so the expression on the righthand side of equation (11) is proportional to fluid mass. In a reciprocating pump, fluid mass taken into the cylinder is equal to that discharged, so that:

$$C_i V_i = K_1 C_d V_d = Q \tag{12}$$

where $K_1$ is the ratio of isentropic compression exponents for the discharge and intake conditions. $K_1$ is generally close to 1 for most real situations, but can be as high as approximately 3 or more.

When a controllable synthetic capacitor 39 is used to simulate a reciprocating compressor, the changes in capacitance represent the changing volume in the cylinder. The input to the synthetic capacitor 39 is coupled to the lower intake voltage $V_i$ through an intake valve 20, and to the higher discharge valve $V_d$ through discharge 22. The valves 20, 22 allow current to flow only from the lower voltage $V_i$ onto the synthetic capacitor 39, and from the capacitor 39 to the higher voltage $V_d$. To simulate a reciprocating cylinder, the gain of the amplifier 38 is varied sinusoidally. It will become apparent from equation 7 that as the magnitude of the gain of amplifier 38 increases, so does the capacitance seen when looking into the amplifier 38, so that the voltage across the synthetic capacitor 39 drops, as is seen in equation 12. When this voltage drops below $V_i$, the intake valve 20 turns ON, and allows current to flow into the capacitor 39. As the synthetic capacitance continues to increase, it continues to collect charge through the intake valve 20. When the magnitude of the gain begins to decrease, the value of synthetic capacitance decreases, raising the voltage on the capacitance 39 above $V_i$ and causing the intake valve 20 to turn OFF. The voltage on the synthetic capacitor 39 continues to rise until it reaches the level of the discharge voltage $V_d$. At that time, the discharge valve 22 turns ON, and current flows into the discharge line 26. The synthetic capacitor 39 discharges at a rate sufficient to keep $E_i$ equal to $V_d$. When the gain of the amplifier 38 increases, the voltage on the capacitor 39 drops, which causes the discharge valve 22 to turn OFF. The synthetic capacitance continues to increase until the voltage across it falls below $V_i$, turning the intake valve 20 ON, and starting the cycle over.

Thus, the synthetic capacitor 39 acts as a charge pump, moving charge from the intake line 24 at the lower voltage $V_i$, to the discharge line 26 at the higher voltage $V_d$. This simulates the action of a reciprocating gas compressor which transfers gas from a lower pressure intake pipe to a higher pressure discharge pipe. The synthetic capacitor 39, when properly controlled as discussed below, therefore simulates the pumping action of a reciprocating compressor driven by a crankshaft, and the changing capacitance presented to the remainder of the circuit when one of the valves 20, 22 is open simulates the changing acoustic compliance presented to the mechanical piping system.

A preferred embodiment of the apparatus 36 for modeling the crankshaft and cylinder of a reciprocating pump or compressor is shown in FIG. 4. A capacitor 40 is coupled to a controllable gain amplifier 42 in a feedback arrangement. Unidirectional valve stimulations 31 will be coupled to terminal 3 as shown in FIG. 1. A field effect transistor $Q_1$ and a bipolar junction transistor $Q_2$ form a high input impedance unity gain buffer amplifier. Voltages $V_{cc}$ and $-V_{ss}$ form the power supply for $Q_1$ and $Q_2$. Capacitors 44, 45 and resistors 46, 47 form a 3 to 1 attenuator network, so that voltage $V_p$ is one third the value of voltage $V_1$ present at terminal 3. $V_p$ is coupled to an analog input of a multiplying digital-to-analog converter 48, and is also available externally for measurement purposes. The other input to the converter 48 is an eight bit digital signal derived from memory $M_1$. The output of the D-A converter is equal to:

$$\text{output} = V_p(N/256) \tag{13}$$

where N is the numerical value of the binary bit pattern which appears on Line $L_1$. N is an integer in the range of 0 to 225, inclusive. The value of N will be changing with time according to information stored in memory $M_1$, so that the time varying output of the multiplier 48 is equal to the analog value of $V_p$ multiplied by the value of N/256. Amplifiers 50 and 52 multiply the analog output from the converter 48 by 3 and $-10$ times respectively, for a total multiplication of $-30$. Since $V_p$ is $\frac{1}{3}$ of $V_1$, the instantaneous output voltage of the controllable amplifier 42 is at most approximately 10 times the magnitude of $V_1$.

The gain of the controllable amplifier 42 is actually given by the equation:

$$K = 0396063(N) \text{ for } 0 \leqq N \leqq 255 \tag{14}$$

Combining this equation with equation (7) gives:

$$C = C_o(0.0396063(N) + 1) \tag{15}$$

Therefore, the impedance at terminal 3 appears as a pure electrical capacitance having a variable value which is controlled by the output from memory $M_1$.

The magnitudes of the scaling factors used in the variable amplifier 42 are not critical, but the values discussed above have been chosen for ease of use with the remainder of the compressor analog circuit.

Data is loaded into memory $M_1$ through an eight bit data input line 54, and a read-write input on line 56 determines whether data is being loaded into the memory $M_1$, or being read out. A second memory $M_2$is similarly loaded through an eight bit data entry line 58, and the read or write status of the second memory $M_2$ is determined by a read-write input on line 60. Address output lines 62, 64 into both memories $M_1$ and $M_2$ are from by a binary counter 66, which, in the preferred embodiment, is an eight bit counter. The counter 66 has a reset input 68, and a clock input 70. The clock input 70 is coupled to the clock 94 located on the status board 30. The two memories $M_1$ and $M_2$ are inherently synchronized since their data are accessed by the same input signal. Likewise, all of the analog cylinders are inherently synchronized since they are driven simultaneously from the same clock signal.

The data output from the second memory $M_2$ is converted to an analog signal in a digital to analog converter 72, the output of which is put through a unity gain buffer amplifier 74. The amplifier output voltage $V_v$ represents the volume within the analog cylinder. The corresponding digital signal on line 76 is also available for digital processing as desired.

The preferred embodiment utilizes two fast random access memories $M_1$ and $M_2$, but other memory devices such as serial shift registers activated by a common clock signal may also be used.

The data stored in $M_2$ represents the time varying volume of the analog cylinder 36, and will be basically sinusoidal. However, a mechanical compressor or pump often has a time varying volume which varies by as much as several percent from a true sinusoid, and the data stored in memory $M_2$ can reflect these distortions. Thus, an accurate signal $V_v$ proportional to cylinder volume is obtainable from the model 36.

The data stored in the first memory $M_1$ varies the analog pressure in the cylinder, which is reflected by the changing voltage $V_1$. A mechanical cylinder presents a difference acoustic compliance to the remainder of the fluid during each of the intake, compression, discharge and expansion portions of the cycle. The data stored in the first memory $M_1$ is obtained from appropriate calculations and reflects these changes. Differences in the constant $K_1$ during different portions of the cycle are also reflected in the data stored in memory $M_1$. Thus, an electrical analog which is accurate in all respects is provided by the present device 36.

The data in both memories $M_1$ and $M_2$ are preferably calculated in the control circuit 28 of FIG. 1, and the information entered into the memories $M_1$ and $M_2$ automatically. This greatly simplifies the task of initializing each analog cylinder 36.

The voltage outputs $V_p$ and $V_v$ reflect the correct pressure and volume information for the analog cylinder 36. The phasing of the cylinder operation is accurately controlled by presetting the counter 66 to a desired value. This allows all of the cylinder analogs 36 to be accurately phased in relation to each other by presetting the counter 66 for each analog cylinder 36 to the desired value. All analog cylinders 36 are operated from a common clock signal, thus eliminating phasing problems encountered in prior art analogs. In the analog of FIG. 1, each of the four analog cylinders 12, 14, 16 and 18 will be phased at 90° from each other as discussed earlier.

Figure 5:
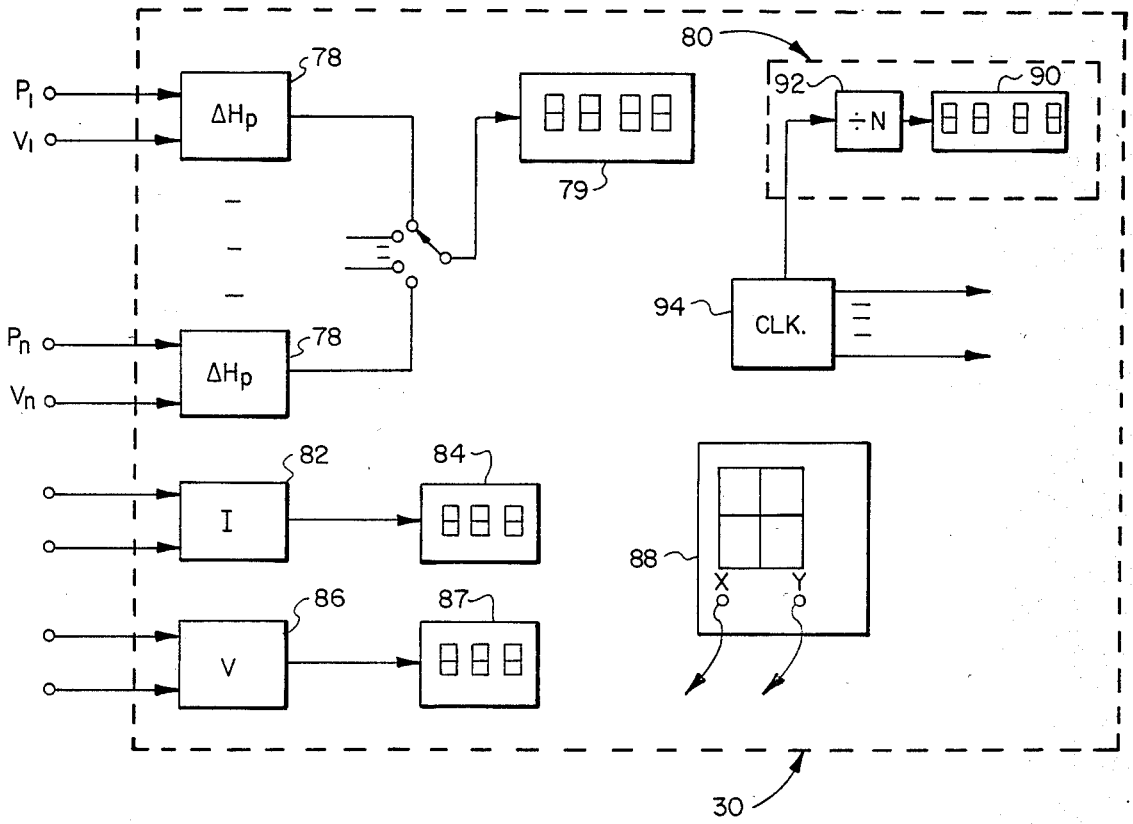
FIG. 5 is a block diagram of a status board for use with the compressor analog.

Referring to FIG. 5, a preferred embodiment of the status board 30 is shown. The basic types of information displayed to the operator include the relative effective horsepower delivered by various compressor cylinders, compressor operating speed, and current (gas) flow at various points within the system analog. Changes in horsepower are indicated for each analog cylinder by relative horsepower ($\Delta$Hp) calculation circuits 78 switchably coupled to a digital display device 79, and compressor speed is indicated in rpm by an analog tachometer 80. A flowmeter 82 is a precision current meter, and has an output display 84 on the status board 30. A preferred embodiment of a precision flowmeter is described below in connection with FIG. 10. The flowmeter 82 can be coupled into the analog at many points to determine current flow at those points. A precision voltmeter 86 is used to measure the analog pressures within the system model at selected points. A standard oscilloscope 88 is also preferably incorporated into the status board 30 in order to observe selected wave forms.

The tachometer 80 includes a display 90 and a ratio set circuit 92. The ratio set circuit 82 comprises a divide-by-n counter which can be preset by manual switches (not shown). These switches are used to select the design parameter$\delta$. The circuit 92 is constructed so that setting the frequency ratio results in an output read directly in rpm. The clock signal is supplied by the digital clock 94, having a frequency typically 256 times the operating frequency $f_e$ of the analog. The clock 94 drives the counters 66 of the cylinder analogs.

Figure 6:
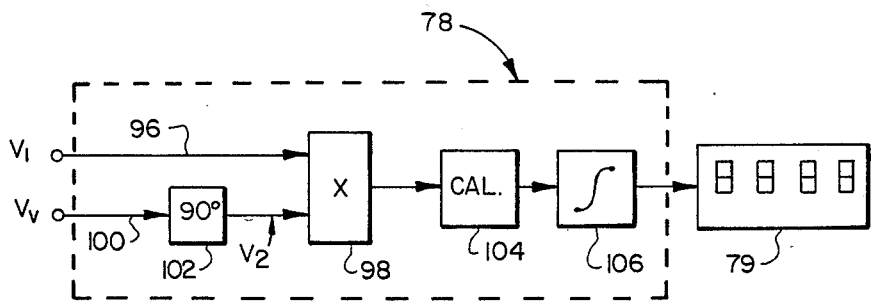
FIG. 6 is a block diagram of a relative horsepower indicator.

Referring to FIG. 6, a preferred embodiment of the relative horsepower calculator circuits 78 is shown. These circuits 78 do not compute the actual horsepower obtained in the analog cylinder 36. Instead, the apparatus 78 measures only changes in the horsepower level. This computation circuit is calibrated with the analog compressor 36 running under an ideal load, and the horsepower output relative to this ideal level is determined when the analog cylinder 36 is coupled into the complete system.

Cylinder horsepower in the mechanical compressor can be calculated form the following equation.

$$Hp = K\int p \cdot d(\mathrm{Vol}) \tag{16}$$

where Hp is horsepower, K is a constant relating horsepower to work, p is cylinder pressure and d(Vol) is the differential of cylinder volume. Since the object of this measurement device is to indicate only relative changes in horsepower, the constant is not necessary and we need only look at the integrand of equation 16. Cylinder pressure in the mechanical system is modeled by voltage $V_1$ in the electrical system, and an equation for mechanical volume Vol as a function of angular crankshaft position $\theta$ is:

$$\mathrm{Vol}(\theta) = \mathrm{Vol}(m) - \mathrm{Vol}(s)\cos\theta \tag{17}$$

where Vol(m) is the cylinder volume with the piston in the center of its travel, and Vol(s) is $\frac{1}{2}$ the total volume swept by the face of the piston. $\theta$ is zero when the piston has reached its midpoint of travel on the compression stroke. By differentiation:

$$d\mathrm{Vol} = \mathrm{Vol}(s)\sin\theta d\theta \tag{18}$$

Since the relative horsepower calculator circuit 78 is concerned only with proportional changes and not with absolute values, the constant Vol(s) is ignored. The volume of the reciprocating cylinder, as stored in memory $M_2$, is represented by $\cos\theta$. Since the derivative ($\sin\theta$) of a sinusoid is another sinusoid, the derivative of the volume is obtained by shifting the analog signal $V_v$ by $+90°$.

The circuit 78 for calculating and indicating relative horsepower is shown in FIG. 6. A first test lead 96 is coupled to terminal 3 of the analog cylinder 36 to measure voltage $V_1$. The other end of this lead 96 is coupled to a first input of a multiplier 98. A second test lead 100 is coupled to the volume output $V_v$ of the analog cylinder 36, and the other end of the second lead 100 is connected to a phase shifter 102. The phase shifter 102 shifts the analog volume ($\cos\theta$) through an angle of $+90°$. The output voltage $V_2$ from the phase shifter 102 is coupled to a second input of multiplier 98. The output of the multiplier 98 is the product of the cylinder voltage $V_1$ and the shifted driving signal voltage $V_2$. In the preferred embodiment, the multiplier 98 is a precision analog multiplier.

The voltage output level of the multiplier 98 is adjusted in a calibration circuit 104, the output of which, in turn, is coupled to an integrator 106. The calibrator 104 is preferably a voltage amplifer having an adjustable gain. The integrator 106 output is coupled to the digital display 79.

In operation, the first and second leads 96, 100 are attached to the appropriate points in the cylinder model 36. The model cylinder 36 is connected into a network representing ideal conditions, such as pumping into a large volume. The display device 79 can be marked in percentages, and the calibration device 104 is adjusted so that the display 79 reads 100% under ideal conditions.

The model cylinder 36 is then coupled into the operational network, and horsepower deviation from the ideal level will be indicated as a percentage on the output meter 79. In this manner, it is possible to observe the net effects of various system conditions and changes on the horsepower output in each analog cylinder 36.

Compressor intake, discharge and transmission line piping is simulated in the analog by lumped parameter delay lines. These delay lines are coupled to the intake and discharge lines 24 and 26 of the analog cylinders 36, and to each other, in an arrangement simulating the actual physical layout of the modeled pumping system. Piping analogs are composed of a plurality of segments, wherein each segment is a pi impedance network having two capacitors in parallel connected to ground at one end, and an inductor coupled between them at the other. Each segment represents a precalculated length of pipe, such a one foot, and the necessary number of segments are coupled together in series to simulate a long pipe.

Figure 7:
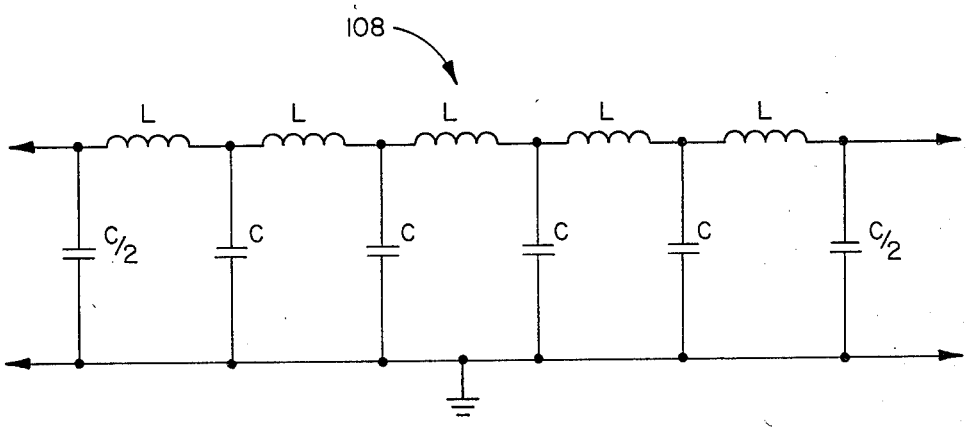
FIG. 7 is a schematic diagram of a pipe analog.

FIG. 7 shows a five segment length of delay line. The values L and C are determined from the following equations:

$$C = \frac{\alpha\gamma}{\beta}\cdot\frac{A\rho}{B} \tag{8}$$

$$L = \frac{\rho\gamma}{\alpha}\cdot\frac{1}{A} \tag{19}$$

$$\epsilon = \frac{\lambda_s}{\lambda_e} \tag{20}$$

$$\gamma = \frac{a_s}{a_e} = \frac{f_s\lambda_s}{f_e\lambda_e} = \delta\epsilon \tag{21}$$

Equations (8) and (20) have been repeated for reference. $\epsilon$ represents the length of pipe simulated by one segment of the delay line, and is chosen so that the length of each segment is no longer than 1/20 the wave length of the highest frequency of interest.

To choose $\epsilon$, the highest frequency to be considered in the analog is determined. The acoustic wavelength of such frequency in the gas is $$\lambda = \mathrm{Vel}/\nu \tag{22}$$

where Vel is the velocity of sound in the gas, at the expected temperatures and pressures, and $\nu$ is the highest frequency to be considered. A suitable $\epsilon$ is chosen to be no longer than 1/20 of $\lambda$.

Since $\delta$ is usually specified, the choice of $\epsilon$ determines the value for $\gamma\cdot\beta$ is selected to give suitable values for the capacitors and inductors in the delay line as determined in equations (8) and (19).

If the system or subsystem of interest will be pumping into a relatively long pipeline, this pipeline can be simulated by considering it as an infinite length pipeline and terminating the analog delay line with its characteristic impedance. The line is also terminated with a DC voltage which represents the static pressure of gas in the line.

Figure 8:
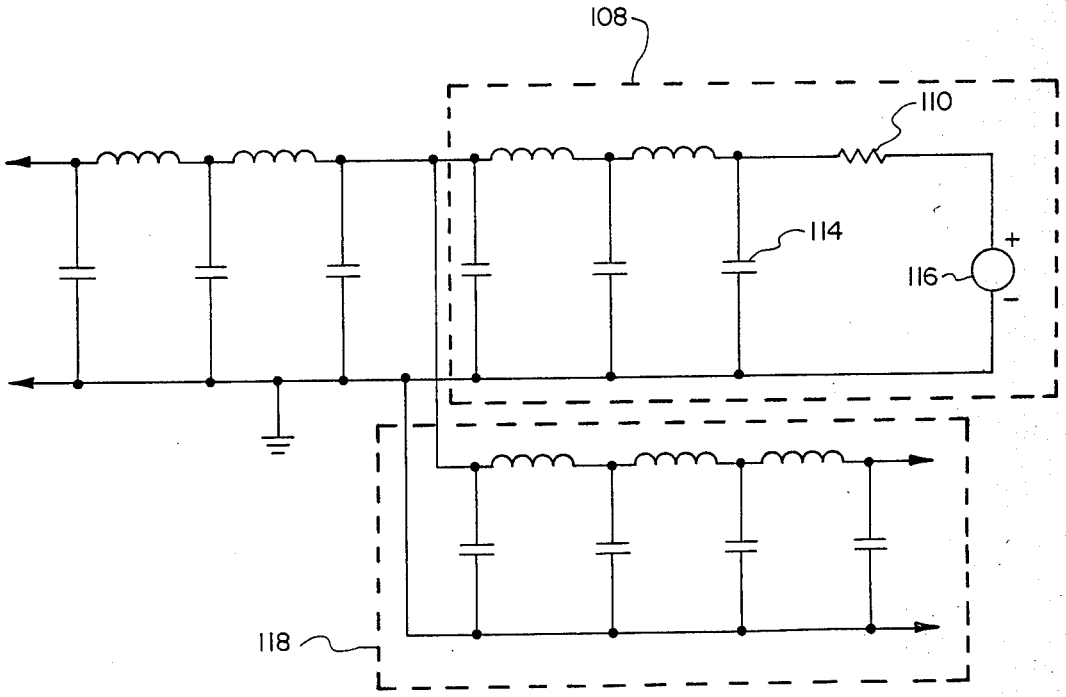
FIG. 8 is a schematic diagram of a pipe analog containing a T junction.

FIG. 8 illustrates the connections to be made to simulate an abrupt T junction in the mechanical piping. Abrupt junctions may be T or Y intersections, or points where the transmission pipeline changes sizes. FIG. 8 shows a T intersection wherein one arm 108 of the junction can be considered infinite for purposes of the simulation, and is therefore terminated with its characteristic impedance, represented by a load resistor 110.

The mechanical gas transmission line will have a static back pressure. This is simulated by a DC voltage source 116 in series with the characteristic impedance resistor 110. Except when an analog cylinder 36 is pumping charge into the line, no DC current will flow through the load resistor 110. When an analog cylinder 36 is pumping into the line, only a DC current representing the charge injected by the analog cylinder 36 will flow through the load resistor 110. The DC voltage across the last pipeline capacitor 114 will be the same as that supplied by the source 116. Since the source 116 has no internal impedance, the terminating impedance seen by the line will be only the value of the load resistor 110. The same arrangement of a load resistor in series with a DC voltage source is used at the terminal ends of intake and discharge lines.

The abrupt T junction is simulated by terminating three delay lines at a single point, with the impedance values of each delay line determined by the mechanical characteristics of the simulated pipes. If additional pipes are joined at the same junction, additional delay lines can be coupled to the junction in the manner of FIG. 8.

Abrupt junctions also occur where a single pipe changes diameter abruptly, such as occurs in a pulsation damping bottle. This is simulated by connecting two delay lines having differing parameters end to end in manner similar to that shown in FIG. 8, but with the lower arm 118 of the T junction removed. In order to accurately simulate the mechanical system, the electrical lines must be coupled together at their proper distances as determined by the mechanical layout. That is, the proper number of delay line segments, each representing a predetermined pipe section having a length $\epsilon$, must be connected in series between each junction.

Centrifugal compressors and pumps are often used in fluid transmission systems, and an electrical analog of such machines greatly increases the flexibility and utility of the analog system. Although the acoustic pumping characteristics of centrifugal machines are quite different from those of reciprocating machines, a reciprocating compressor model can be made the basis of a centrifugal compressor analog. The centrifugal analog can be considered an accurate model if the output, as a function of the input, accurately corresponds to the output function of the mechanical machine.

Figure 9:
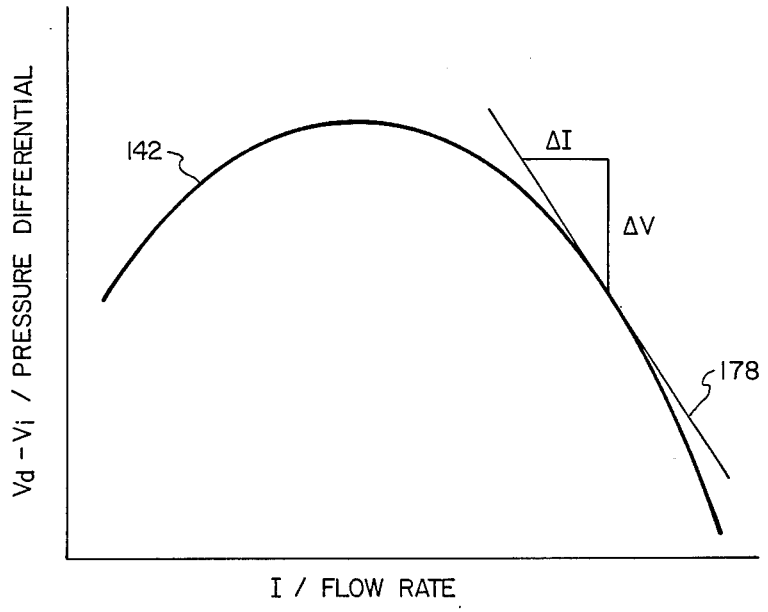
FIG. 9 is a simplified pressure versus flow diagram for a centrifugal compressor.

A typical centrifugal compressor output curve 142 is shown in FIG. 9. For the mechanical machine, the abscissa axis represents volume of fluid flow per unit time, and the ordinate axis represents the pressure differential across the compressor. For the electrical analog, the abscissa represents the current through the analog, while the ordinate represents the voltage differential across it.

Figure 10:
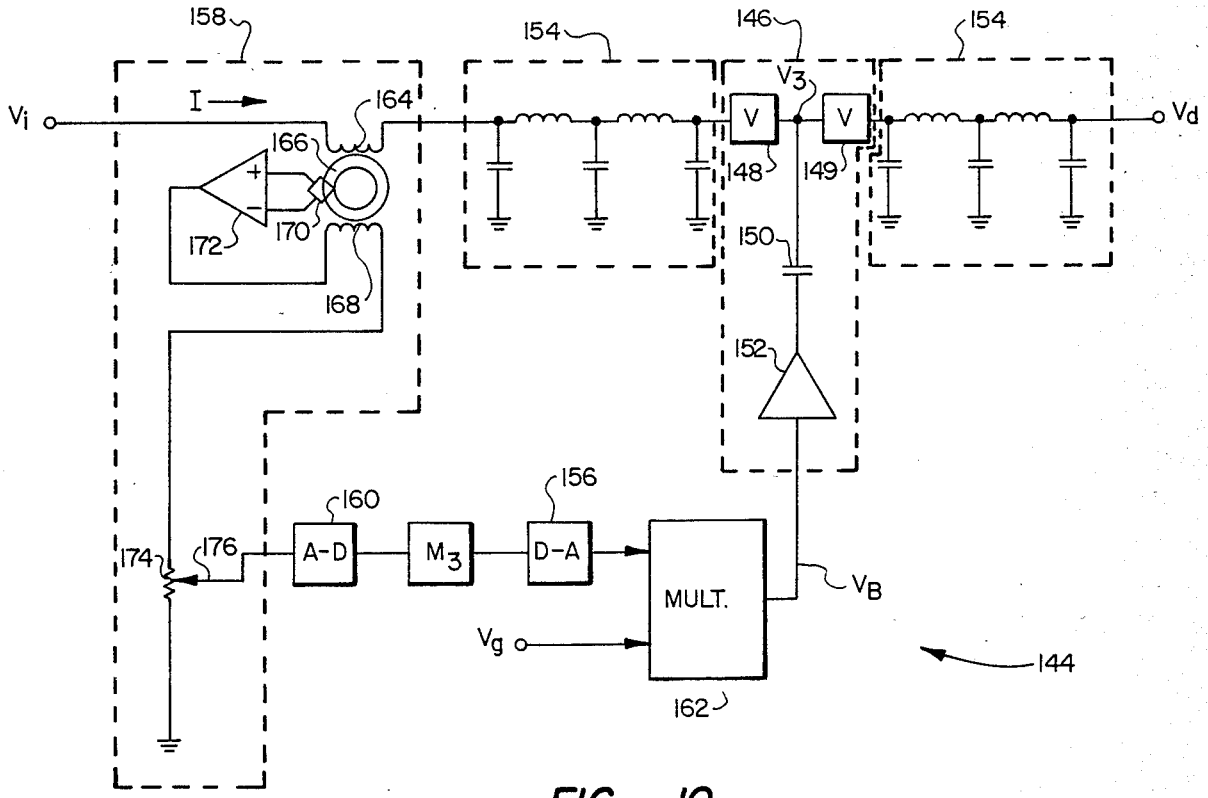
FIG. 10 is a circuit diagram of a centrifugal compressor analog.

A preferred embodiment of a centrifugal analog 144 is shown in FIG. 10. This analog 144 utilizes generally a reciprocating pump analog operating at very high frequencies. When the operating frequency is sufficiently high, and proper filters are used, the reciprocating analog portion of the centrifugal analog 144 appears to the remainder of the system as a simple voltage increase which transfers current from the input to the output. As in a mechanical centrifugal compressor, no pulsations occur in the analog output when the intake voltage (pressure) and current (gas flow) remain constant.

A reciprocating pump portion 146 has two valves 148, a capacitor 150, and a unity-gain buffer amplifier 152. The valves 148 can be diode valves, or active analog valves 31, with diodes being used in the preferred embodiment for simplicity. These diodes do not represent valves in the mechanical system; they are used merely to control current flow. When the amplifier 152 is driven by a sinusoidal voltage source, the reciprocating portion 146 acts as a charge pump, delivering electrical charge from a lower intake voltage $V_i$ to a higher discharge voltage $V_d$. Junction voltage $V_3$ tracks the sinusoidal output of the amplifier 152. When $V_3$ drops below $V_i$, current flows through the intake piping (not shown) and onto the capacitor 150. $V_3$ will not drop below more than an amount equal to any voltage drop across the intake valve 148. As the output of the amplifier 152, and therefore $V_3$, begins to rise, current flow through the intake valve 148 is cut off. The charge on the capacitor 150 remains there until $V_3$ rises above $V_d$, whence the charge on the capacitor 150 flows through valve 149 and into the discharge piping (not shown). When $V_3$ begins to drop, tracking the output of amplifier 152, the current through valve 149 cuts off. $V_3$ falls until it reaches $V_i$, and the cycle repeats.

The reciprocating portion 146 operates at a frequency much higher than the operating frequency of the analog system. For example, if the reciprocating compressor analogs 10 are modelling a compressor operated at 1800 RPM, and $\delta=1000$, the fundamental operating frequency of the analog system is 30 KHz. The driving input voltage $V_g$ typically operates at 5 MHz. High frequency filters 154 block this higher frequency from the remainder of the system. When looking in the intake or discharge terminals, the system "sees" only a DC voltage differential across the analog 144. The intake and discharge currents are the same; only the voltage has changed.

Voltage $V_B$ drives the reciprocating portion 146, and is the time-varying product of $V_g$ and the output of a D-A converter 156. The peak-to-peak amplitude of $V_B$ determines the pressure differential across the centrifugal analog 144. The voltage-current relationship in the analog 144 is given by the equation $$I=fC_1(V_B+V_i-V_d) \tag{23}$$

where I is the current pumped through the analog 144; f is the analog operating frequency, which is the frequency of $V_g$; and $C_1$ is the value of capacitor 150. Solving equation (23) for $V_B$ gives $$V_B=V_d-V_i+I/fC_1 \tag{24}$$

$V_d-V_i$ is the voltage differential acorss the analog 144, and is a function of the current flowing through the analog 144. This voltage differential can be read directly off of FIG. 9 when the precise characteristics of the analog 144 and mechanical compressors are known. Thus, the necessary value of $V_B$ for the analog 144 to accurately model the mechanical compressor can be calculated once I is known.

A preferred method for determining the necessary values of $V_B$ is shown in FIG. 10. The current I flowing through the analog 144 is measured by current meter 158. This value is digitized in A-D converter 160, and the digital signal accesses a memory $M_3$. $M_3$ is loaded in advance with suitable values of $V_B$ corresponding to various values for I, which are calculated from equation (24) and the compressor specification. As I changes, different locations in memory $M_3$ are accessed. The data are stored in $M_3$ so that the data accessed by a particular current flow gives the corresponding value for $V_B$. These values are converted to analog form in A-D converter 156, and multiplied by $V_g$ in an analog multiplier 162. Thus, the peak-to-peak value of $V_B$ varies with changes in I, and has the same frequency as $V_g$.

Current meter 158 is a precision meter useful for the very small currents typically encountered in the analogs of the present invention. The impedance of standard meters, though small, is large enough to have an effect on system operations. Meter 158 has virtually no effect on the system, presenting only a negligible resistance to current I. A sensing coil 164 is wrapped around a preferably toroidal core 166 in the manner of a transformer primary. A balancing coil 168 is wrapped around the core 166 in the manner of a transformer secondary. A Hall effect sensing device 170 is embedded in the core 166, and is positioned to detect magnetic flux passing through the core 166 in either direction around the central void. The sensing device 170 is coupled to both inputs of a precision differential amplifier 172, which has an output coupled to the balancing coil 168. The existence of magnetic flux passing through the Hall effect sensor 190 causes a differential signal to be sent to the amplifier 172, which increases or decreases its output current in response. The current through the balancing coil 168 causes a magnetic flux in the core 166 which opposes that caused by the sensing coil 164. This acts in feedback through the Hall effect sensor 170 so that, assuming an equal number of turns for the sensing and balancing coils 164, 168, the current through the balancing coil 168 is equal to the current I. If there are unequal numbers of turns of the two coils 164, 168, the current through the balancing coil will be proportional to I by the turns ratio. For example, if there are four sensing coil 164 turns for each balancing coil 168 turn, the current through the balancing coil 168 will be four times that through the sensing coil 164. The current meter 158 is described more fully in application Ser. No. 094,507, filed Nov. 16, 1979, now abandoned, the disclosure of which is incorporated herein by reference.

The current flowing through the balancing coil 168 passes through a calibrating potentiometer 174. The voltage picked off by line wiper arm 176 is coupled to the A-D converter 160, which accesses memory $M_3$ as discussed above.

The current meter 158 as above described senses small currents flowing through the system without affecting the system due to internal impedances. Since any flux which tends to be generated in the core 166 is opposed by that generated by the balancing coil 168, the only impedance exhibited by the current meter 158 to the remainder of the system is the resistance of the sensing coil 164. This resistance is so small as to have negligible effects on system operation. This makes the meter 158 described above especially useful throughout the analog system, as well as incorporated in the centrifugal analog 144. It is preferably used in the embodiment described in connection with FIG. 5 and that described in connection with FIG. 11.

In FIG. 9, output curve 142 represents a typical output specifications curve for a centrifugal compressor. The ordinate axis differs slightly in that it indicates a pressure differential, while a standard compressor curve indicates discharge pressure. However, a standard curve is generally referenced to a nominal suction pressure, so that the discharge pressure equals the pressure differential. A family of output curves may be shown, representing discharge pressures for various suction pressure. These curves comprise basically the original curve displaced vertically an amount equal to the difference in suction pressure. In generally encountered operating regions, the pressure differential remains substantially constant for a given flow rate, so that use of single curve 142 provides accurate results.

Line 178 is tangent to output curve 142 at a single point. The slope of line 178 is $\Delta V/\Delta I$, which defines an electrical impedance. This impedance is analogous to the acoustical impedance of the mechanical compressor, which is proportional to the pressure differential and the flow rate. Since the voltage-current ratio in the analog is always forced to correspond to the pressure differential-flow rate ratio, the electrical impedance in the analog 144 corresponds to the acoustical impedance in the compressor. This allows the analog system to accurately model the acoustical properties of the mechanical system.

The preferred centrifugal analog 144 utilizes a digital memory loaded with predetermined values for $V_B$. Other methods for determining $V_B$ are possible, however. Since the output curve 142 is generally parabolic, an analog calculating circuit (not shown) can be used to calculate the necessary values for $V_B$ in real time. However, doing so requires determining an equation which will generate the output curve 142, rather than merely plotting data points as is done when a digital memory $M_3$ is used. Additionally, analog calculating circuits are generally accurate to at best a few percent. For these and other reasons, the centrifugal analog 144 described above is preferred.

An alternate embodiment of the present invention uses a single control means, such as a general purpose digital computer, to initially set up and operate the system, and to collect and interpet results. This control means replaces the initializing control circuit 28 and the status board 30 of FIG. 1, the memories $M_1$, $M_2$ and counter 66 of the analog cylinder 36, and memory $M_3$ of the centrifugal analog 144.

Figure 11:
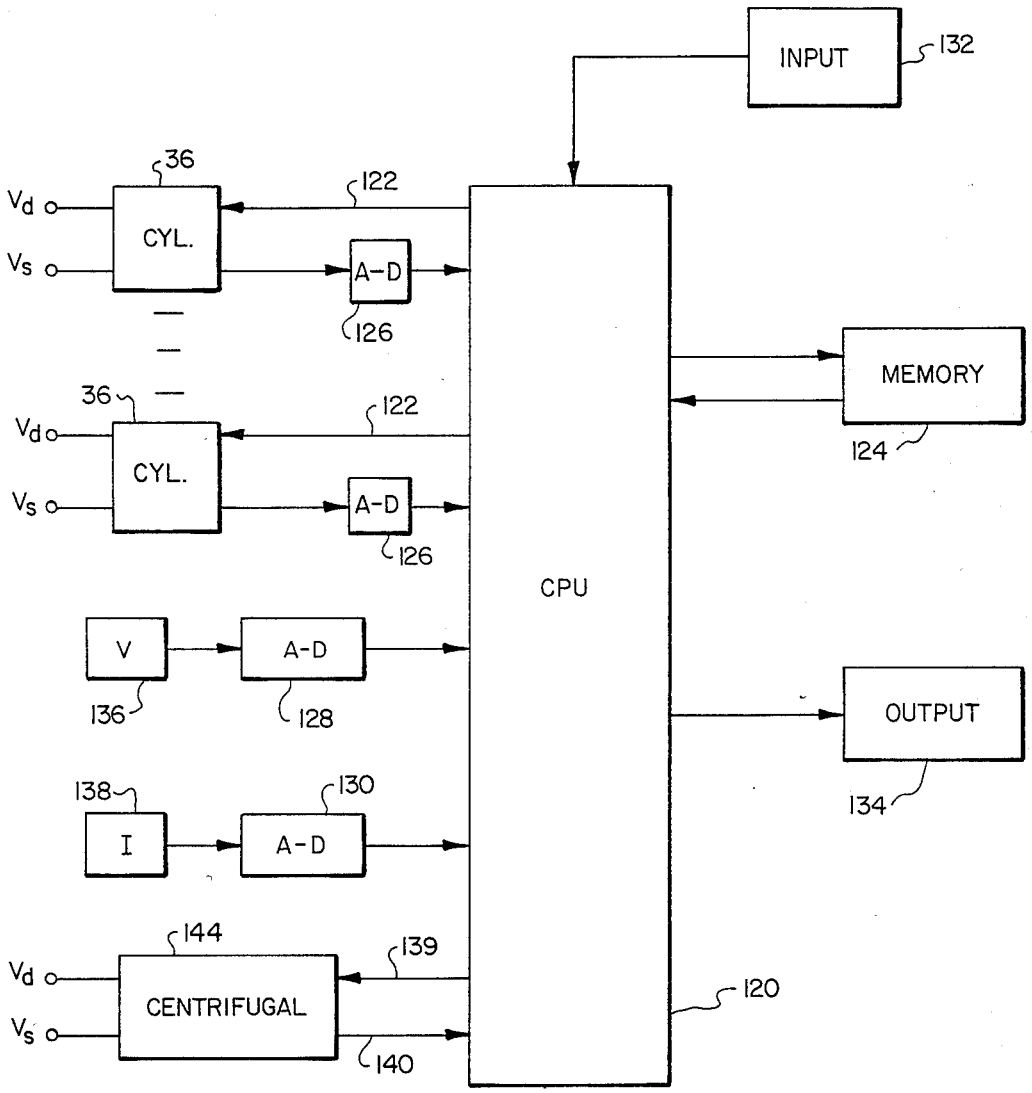
FIG. 11 is a block diagram of an alternate embodiment of the present invention utilizing a central processing control for operation.

Referring to FIG. 11, a central processor 120 is coupled to each reciprocating analog 36 by data lines 122. These lines 122 are coupled to the multiplying D-A converter 48 in place of data line $L_1$, shown in FIG. 4. The data used to operate the analog cylinders 36 is calculated in the central processor 120, and stored in memory 124. The reciprocating analogs are operated by reading the cylinder data from memory 124 in a manner similar to the operation described in connection with FIG. 4, except that operation is controlled by the CPU 120, which can operate a plurality of cylinders 36 simultaneously. The data corresponding to the volume of each analog cylinder 36 is calculated in advance in the CPU 120, and stored in memory 124 for later use.

Instantaneous pressure in each analog cylinder 36 is available as an analog waveform, and must pass through analog-to-digital converters 126 prior to processing. Instantaneous voltage (pressure) and current (gas flow) waveforms elsewhere in the system are detected by voltmeters 136 and ammeters 138, and passed through respective A-D converters 128, 130 prior to processing.

The current processor 120 is coupled to the centrifugal analogs 144 (only one is shown in FIG. 11) by data lines 139, 140. The processor replaces $M_3$ directly. Data line 140 carries the value representing current flowing through the compressor 144, and line 139 carries the corresponding data for $V_B$. The data corresponding to $V_B$ is precalculated and stored in memory 124, and the data on line 140 is stored during operation for later recreation of the analog compressor 144 conditions.

Operation of the simulation preferably passes through three discreet stages. First, the operator enters the parameters controlling the simulation through an input device 132, which is preferably a keyboard terminal of any suitable type. The processor 120 then calculates the data necessary to drive the analog cylinders 36 and the centrifugal analog 144, and stores it in memory 124. The processor 120 may also be used to calculate the appropriate inductor and capacitor values to be used in the simulation.

The compressor analog 36, 144 are coupled together with piping analogs to simulate the physical system as described above. Once the system analog has been set up, the second stage comprises the actual operation of the system. The processor 120 drives the simulation, and records data on cylinder 36 voltages, centrifugal analog 144 currents and piping voltages and currents, in the memory 124.

The third stage comprises analysis of the data accumulated in stage two. This can include cylinder horsepower calculations and analysis of transmission line voltages for resonances. The results of the simulation run are conveniently plotted or printed out on an appropriate output device 134. Any desired modifications can be made to the analog, and the procedure repeated.

Figure 12:
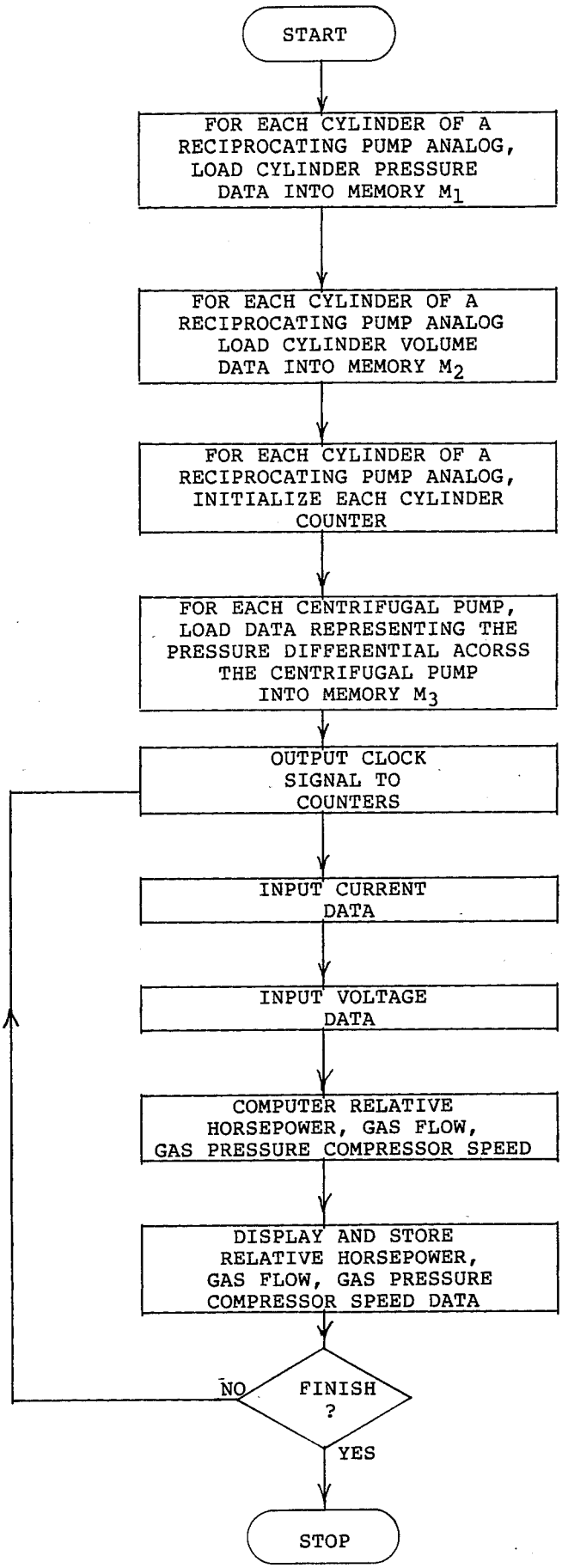
FIG. 12 is a functional flowchart of software executed by a computer for the simulation system.

FIG. 12 is a functional flowchart of the software to be executed by the central processing unit of FIG. 11. It should be understood that the function of the central processor is merely to expedite the loading of the memories for the circuitry simulating the cylinders of the reciprocating cylinder compressor or pumps and for the memory of the centrifugal pumps circuits. Once these memories have been loaded, the initiation of system operation is accomplished by the transmission of the clock signals to the counters of the reciprocating cylinder compressors or pumps to simulate the operation of these pump cylinders. The central processing unit 120 is also useful in recording the current and voltage data at selected test points on the simulation circuitry. The current and voltage data are then used in accordance with the equations previously discussed to compute relative horsepower, gas flow, gas pressure and compressor speed. The central processing unit 120 of FIG. 11 may also be used to output this computed data to a display. It should also be understood by those skilled in the art that this data may be stored as opposed to displayed and that the input data from the simulating system may be stored for later computation of the acoustical property parameters.

Although preferred embodiments have been described in detail, it should be understood that various substitutions, alterations, and modifications may become apparent to those skilled in the art. These changes may be made without departing from the spirit and scope of the invention as defined by the appended claims.

What is claimed is:

1. A system for electrically simulating the acoustical properties of a fluid transfer system, comprising:

means for electrically simulating acoustic properties of fluid piping;

means coupled to said piping simulation means for electrically simulating acoustic properties of fluid transfer through at least one cylinder of a reciprocating compressor, wherein said compressor simulating means includes a variable capacitance means for varying capacitance to simulate varying fluid flow through the compressor piston and cylinder; and means coupled selectively to said piping simulation means and to said cylinder simulation means for displaying the electrical characteristics analogous to the acoustical properties of the system.

2. The system of claim 1 wherein said piping simulation means comprises at least one lumped parameter delay line.

3. The system of claim 2, wherein each delay line comprises at least one section, wherein multiple sections are coupled together in series, and wherein each section simulates a portion of pipe having a length of less than approximately 1/20th of a wavelength of the highest acoustical frequency to be considered.

4. The system of claim 1 wherein said compressor simulating means includes:

means for simulating the action of unidirectional mechanical valves;

said variable capacitance coupled to said valve simulation means, wherein the magnitude of capacitance is electrically controllable; and control means coupled to said variable capacitance for controlling its magnitude in a predetermined manner.

5. The system of claim 4, further including;

means for generating a first signal corresponding to the volume of each cylinder being simulated; and means for obtaining a second signal corresponding to the instantaneous fluid pressure in each cylinder.

6. The system of claim 4, wherein said variable capacitor comprises:

an amplifier having a variable gain; and a fixed-value capacitor coupled to said amplifier in a negative feedback arrangement.

7. The system of claim 4, wherein said valve simulating means comprises:

a field effect transistor having drain, source, and gate terminals;

a voltage comparator having an output coupled to the transistor gate, and inputs coupled to the transistor drain and source; and a power supply for said transistor.

8. The system of claim 4, wherein said control means includes a digital memory, wherein the contents of said memory include data representing the cylinder pressure and the cylinder volume as a function of piston crankshaft angle.

9. A system for electrically simulating the acoustical properties of a fluid transfer system, comprising:

means for electrically simulating the acoustic properties of fluid piping;

means coupled to said piping simulation means for electrically simulating the acoustic properties of fluid transfer through a centrifugal compressor including means for transferring electric charge from a lower voltage to a higher voltage wherein change in the electric charge simulates the transfer of fluid gas, means for providing a high frequency voltage signal coupled to said charge transfer means wherein a discrete amount of electric charge is transferred to a higher voltage during each cycle of said high frequency signal, and further wherein the amount of charge in each portion and the maximum potential through which the charge can be raised are dependent upon the magnitude of said high frequency signal, and means for controlling the amplitude of said high frequency signal; and means coupled selectively to said piping simulation means and to said centrifugal simulating means for displaying the electrical properties representing acoustical properties of the system.

10. The system of claim 9 wherein said piping simulation means comprises at least one lumped parameter delay line.

11. The system of claim 10, wherein each delay line comprises at least one section, wherein multiple sections are coupled together in series, and wherein each section simulates a portion of pipe having a length of less than approximately 1/20th of a wavelength of the highest acoustical frequency to be considered.

12. The system of claim 11 wherein said charge transfer means comprises:

a first unidirectional device coupled to the lower voltage which allows current to flow onto a transfer junction;

a second unidirectional device coupled to the higher voltage which allows charge to flow away from the transfer junction; and a capacitor having one end coupled to the transfer junction and a second end coupled said high frequency signal means.

13. The system of claim 12 wherein said controlling means comprises:

means for detecting the amount of current flowing into said change transfer means, said detecting means having a voltage output proportional to the rate of current flow;

a memory having a plurality of storage locations;

means coupled to said detecting means for selectively accessing individual storage locations, wherein the storage location selected is a function of the output voltage of said detecting means; and means for multiplying the value stored in the selected storage location by the amplitude of the said high frequency signal, said multiplying means having an output coupled to said charge transfer means.

14. A system for simulating a reciprocating fluid compressor, comprising:

means for simulating a plurality of pipes;

means for simulating at least one reciprocating compressor cylinder;

at least one intake valve simulation coupled to each cylinder simulating means and to at least one pipe simulating means;

at least one discharge valve simulation coupled to each cylinder simulating means and to at least one pipe simulating means;

at least one voltmeter adapted for connection to selected test points in the system;

at least one current meter adapted for connection to selected test points in the system;

central processing means, coupled to an output of each voltmeter and current meter, and coupled to an input and an output of each of said cylinder simulating means, for providing a control signal to the cylinder simulating means for enabling the cylinder simulating means to simulate operation of the compressor's cylinder and for recording the signals received from the voltmeter and current meter;

a memory device having an input and an output, each coupled to said processing means;

an information output device, having an input coupled to said processing means; and an information input device, having an output coupled to said processing means.

15. The system of claim 14, wherein said cylinder simulating means comprises:

a control input line;

an amplifier having a gain proportional to a signal present on said control input line; and a fixed value capacitor coupled to said amplifier in a negative feedback arrangement, wherein said intake and discharge valve simulations are coupled to said capacitor on the side nearest an input to said amplifier.

16. A system for electrically simulating acoustic properties of a fluid compressor, comprising:

means for electrically simulating acoustic properties of a plurality of pipes;

means coupled to said pipe simulating means for electrically simulating acoustic properties of at least one centrifugal compressor including a first memory means for storage of compressor performance data;

at least one voltmeter adapted for connection to selected test points in the system;

at least one current meter adapted for connection to selected test points in the system;

central processing means, coupled to an output of each voltmeter and current meter, and coupled to an input and an output of each of said compressor simulating means, for loading said first memory means and for recording the signals received from the voltmeter and current meter and for computing system operating data;

a second memory device having an input and an output, each coupled to said processing means and for storage of test point data and system operating data;

an output means for displaying system operating data; and an input means for inputting data and control information.

17. A system for electrically simulating acoustic properties of a fluid pumping system, comprising:

means for electrically simulating acoustic properties of a plurality of pipes;

means for electrically simulating acoustic properties of at least one reciprocating compressor cylinder including a first memory means for storing cylinder operational data;

at least one intake valve simulation means for electrically simulating acoustic properties of an intake valve, and coupled to each cylinder simulating means and to at least one pipe simulating means;

at least one discharge valve simulation means for electrically simulating acoustical properties of a discharge valve, and coupled to each cylinder simulating means and to at least one pipe simulating means;

means coupled to said pipe simulating means for electrically simulating acoustic properties of at least one centrifugal compressor including second memory means for storing compressor operational data;

at least one voltmeter adapted for connection to selected test points in the system;

at least one current meter adapted for connection to selected test points in the system;

central processing means, coupled to an output of each voltmeter, current meter, said first and second memory means, for loading said first and second memory means and recording the signals received from the volt meter and current meter, and for computing system operating data;

a memory device having an input and an output, each coupled to said processing means;

an output device, coupled to said processing means and for displaying system operating data; and an input device, coupled to said processing means.

18. An apparatus for simulating a centrifugal compressor or pump, comprising:

an intake terminal connected to an input voltage source electrically simulating the input of fluid gas;

a discharge terminal;

a capacitor having first and second ends;

a first diode coupled between said intake terminal and the first end of said capacitor, wherein current can flow only from said intake terminal to said capacitor first end;

a second diode coupled to the first end of said capacitor and said discharge terminal, wherein current can flow only from said capacitor first end to said discharge terminal;

source means for applying an alternating voltage signal to said capacitor second end at a frequency at least ten times higher than the input voltage source frequency;

means for detecting the magnitude of current flow from said intake terminal to said discharge terminal;

means coupled to said current detecting means for generating an amplitude control signal; and means coupled to said generating means for controlling the amplitude of said source means as a function of the control signal.

19. The apparatus of claim 18 wherein said generating means comprises:

a digital memory having a plurality of storage locations;

an analog to digital converter coupled to said current detecting means and to said memory for accessing selected storage locations as a function of the magnitude of detected current; and a digital to analog converter coupled to the output of said memory.

20. The apparatus of claim 18 wherein said current detecting means comprises:

a magnetically permeable core;

a sensing coil wrapped around a portion of said core;

a balancing coil wrapped around a portion of said core;

a Hall effect sensor coupled to said core;

a differential amplifier having inputs coupled to outputs of said Hall effect sensor, and an output coupled to a first end of said balancing coil, wherein said differential amplifier generates a signal when a non-zero level of magnetic flux occurs in said core; and means coupled to a second end of said balancing coil for generating a voltage signal proportional to the current flowing through said balancing coil.

21. The apparatus of claim 18 further comprising:

a first low-pass filter coupled between said intake terminal and said first unidirectional device; and a second low-pass filter coupled between said second unidirectional device and said discharge terminal.

* * * * *

UNITED STATES PATENT AND TRADEMARK OFFICE

CERTIFICATE OF CORRECTION

PATENT NO. : 4,559,610

DATED : December 17, 1985

INVENTOR(S) : Cecil R. Sparks, Carl E. Edlund and Morton E. Brown

It is certified that error appears in the above-identified patent and that said Letters Patent is hereby corrected as shown below: Title page:

The Assignee "Southwest Research Corporation, San Antonio, Texas" should be --Southern Gas Association, Dallas, Texas, Column 2, line 31, "this" should be --then--.

Column 2, line 49, "not" should be --no--.

Column 3, line 37, "interation" should be --interaction--.

Column 3, line 41, "capacitance" should be --capacitor--.

Column 4, line 46, "corresponding" should be --correspond--.

Column 4, line 56, "mode" should be --model--.

Column 5, line 51, delete "and" (1st occurrence).

Column 5, line 66, "mode" should be --model--.

Column 6, line 38, "resistance" should be --resistances--.

Column 7, line 16, "to the positive of the" should be --to the positive input of the--.

Column 8, line 27, "valve" should be --voltage--.

UNITED STATES PATENT AND TRADEMARK OFFICE

CERTIFICATE OF CORRECTION

DATED : December 17, 1985

INVENTOR(S) : Cecil R. Sparks, Carl E. Edlund and Morton E. Brown

It is certified that error appears in the above-identified patent and that said Letters Patent is hereby corrected as shown below:

Column 8, line 28, before 22 should be --valve--.

Column 8, line 43, "capacitance" should be --capacitor--.

Column 9, line 5, "stimulations" should be --simulations--.

Column 9, line 35, should be written --.0396063-- (period needs to be added).

Column 9, line 55, "output" should be --input--.

Column 9, line 56, "from" should be --accessed--.

Column 10, line 68, "82" should be --92--.

Column 11, line 20, "form" should be --from--.

Column 12, line 53, "wave length" should be --wavelength--.

Column 14, line 66, "acorss" should be --across--.

Column 15, line 17, "A-D" should be --D-A--.

Column 15, line 54, "Nov. 16" should be --Nov. 15--.

Column 15, line 58, "line wiper" should be --the wiper--.

UNITED STATES PATENT AND TRADEMARK OFFICE

CERTIFICATE OF CORRECTION

PATENT NO. : 4,559,610

DATED : December 17, 1985

INVENTOR(S) : Cecil R. Sparks, Carl E. Edlund and Morton E. Brown

It is certified that error appears in the above-identified patent and that said Letters Patent is hereby corrected as shown below:

Column 16, line 50, "interpet" should be --interpret--.

Column 17, line 18, "discreet" should be --discrete--.

Column 19, line 14, "dependent" should be --depended--.

Signed and Sealed this

*Sixth* Day of *May 1986*

[SEAL]

*Attest:*

DONALD J. QUIGG

*Attesting Officer*

*Commissioner of Patents and Trademarks*